US008572762B2

(12) United States Patent
Herbener et al.

(10) Patent No.: US 8,572,762 B2
(45) Date of Patent: Nov. 5, 2013

(54) WEIGHT DISTRIBUTION AND SUPPORT DEVICE AND SYSTEM FOR ARMOR VESTS

(75) Inventors: David E. Herbener, Birchrunville, PA (US); Andrew G. Wall, Alto, GA (US); Joseph D. Massam, Langhorne, PA (US); Kailyn N. Lynch, Glenside, PA (US); John F. Ficker, Philadelphia, PA (US); Kaniyanthra Arjun Joseph, Chennai (IN)

(73) Assignee: KDH Defense Systems, Inc., Eden, NC (US)

( * ) Notice: Subject to any disclaimer, the term of this patent is extended or adjusted under 35 U.S.C. 154(b) by 0 days.

(21) Appl. No.: 13/130,573

(22) PCT Filed: Nov. 20, 2009

(86) PCT No.: PCT/US2009/065353

§ 371 (c)(1),
(2), (4) Date: Apr. 23, 2012

(87) PCT Pub. No.: WO2010/059951

PCT Pub. Date: May 27, 2010

(65) Prior Publication Data

US 2012/0233750 A1 Sep. 20, 2012

Related U.S. Application Data

(60) Provisional application No. 61/199,933, filed on Nov. 20, 2008.

(51) Int. Cl.
*F41H 1/02* (2006.01)

(52) U.S. Cl.
USPC ..... 2/2.5; 2/464; 2/465; 2/467

(58) Field of Classification Search
USPC ..... 2/2.5, 463, 321, 464, 467, 465, 462, 92, 2/69, 311, 338, 322, 102, 44, 45, 46, 107, 2/108
See application file for complete search history.

(56) References Cited

U.S. PATENT DOCUMENTS 3,452,362 A * 7/1969 Korolick et al. ..... 2/2.5
4,004,579 A 1/1977 Dedo (Continued)

FOREIGN PATENT DOCUMENTS

WO 2008/127784 A2 10/2008

OTHER PUBLICATIONS

PCT/US2009/065353, International Search Report dated Jan. 21, 2010, 2 pages.

(Continued)

*Primary Examiner* — Danny Worrell
*Assistant Examiner* — Khaled Annis
(74) *Attorney, Agent, or Firm* — Blank Rome LLP

(57) ABSTRACT

A load bearing weight distribution device is provided. The device comprises a flexible, yet rigid, back brace, a waist belt, wherein the waist belt is connected through a housing to back brace, and a vertical and circumferential tensioning mechanism. The back brace comprises flexible body with arms. The vertical and circumferential tensioning mechanism comprises a first securement strap and a second securement strap. The load bearing weight distribution device is designed for use with armor vests and other similar devices. First and second securement straps connect upper front portion of the armor vest through first and second channels and first and second rings, respectively, of the back portion and through first and second passages of the armor vest, respectively, for attachment to a securement device positioned on a lower front portion of the armor vest.

18 Claims, 17 Drawing Sheets

(56) References Cited

U.S. PATENT DOCUMENTS

| | | | | |
|---|---|---|---|---|
| 4,601,067 | A * | 7/1986 | Buonassissi | 2/102 |
| 4,697,285 | A * | 10/1987 | Sylvester | 2/2.5 |
| 5,398,339 | A | 3/1995 | Wagner | |
| 5,479,659 | A * | 1/1996 | Bachner, Jr. | 2/2.5 |
| 5,548,843 | A | 8/1996 | Chase et al. | |
| 5,836,489 | A | 11/1998 | Swetish | |
| 7,243,376 | B2 | 7/2007 | Johnson | |
| 7,748,053 | B1 * | 7/2010 | Hancock | 2/2.5 |
| 2004/0221361 | A1 | 11/2004 | D'Annunzio | |
| 2005/0005342 | A1 | 1/2005 | Johnson | |
| 2005/0015837 | A1 * | 1/2005 | Saito | 2/2.5 |
| 2005/0066426 | A1 | 3/2005 | White | |
| 2007/0107109 | A1 * | 5/2007 | Johnson | 2/102 |
| 2008/0010730 | A1 | 1/2008 | Twito et al. | |

OTHER PUBLICATIONS

PCT/US2009/065353, Written Opinion dated Jan. 21, 2010, 5 pages.

PCT/US2009/065353, International Preliminary Report on Patentability dated Jun. 3, 2011, 7 pages.

PCT/US2011/026767, International Search Report dated May 12, 2011, 3 pages.

PCT/US2011/026767, Written Opinion dated May 12, 2011, 4 pages.

International Application No. PCT/US2011/026767, International Search Report, dated May 12, 2011, 2 pages.

International Application No. PCT/US2011/026767, International Preliminary Report on Patentability and Written Opinion, dated May 12, 2011, 5 pages.

* cited by examiner

WEIGHT DISTRIBUTION AND SUPPORT DEVICE AND SYSTEM FOR ARMOR VESTS

CROSS-REFERENCE TO RELATED APPLICATION

This application is a U.S. national phase application of PCT International Application No. PCT/US2009/065353, entitled "Weight Distribution and Support Device and System for Armor Vests" and filed Nov. 20, 2009, which claims the priority of U.S. Provisional Patent Application Ser. No. 61/199,933, entitled "Armor Vest Harness and System" and filed Nov. 20, 2008, the contents of which provisional patent application are incorporated herein by reference.

FIELD OF THE INVENTION

The invention relates generally to body armor and specifically to devices and systems for supporting the weight of an armor vest by distributing the weight of the armor vest and plates off of the shoulders, neck, and back to at least the hips of a wearer of the armor vest.

BACKGROUND OF THE INVENTION

Military and police use many different types and styles of body armor systems. The mainstay armor vest serves as a primary feature of most body armor systems. The armor vest is worn to provide ballistic and fragmentation protection to the wearer of the vest. The armor vest, which is worn around the torso and over the shoulders, houses armor plates, ballistic packs, and other forms of soft armor protection. The armor plates and other armor of a vest provide protection from at least small arms fire to promote survivability of the wearer of the armor vest.

In the age of modern warfare, heavy flak jackets have been replaced with lighter and more mobile forms of body armor systems. These systems include armor vests that may be equipped with devices to protect the neck, throat, and groin areas. An example of modern body armor system includes, but is not limited to, the Interceptor body armor system having ballistic packs and optional front and rear armor plates. Modern body armor uses lighter advanced ballistic packs and plates designed to provide soldiers with functional body armor having maximum flexibility and protection from ballistic and fragmentation projectiles.

One feature of body armor is to provide protection for at least central regions of the torso of the wearer by maintaining armor plates in strategic positions to protect vital organs. While modern technology has developed new materials for armor plates, there remains one certainty, the armor plates, which are designed to stop rounds of 7.62 mm or less, remain the heaviest component of the armor vest. Even with the advantages provided through use of Kevlar, ceramic, and other ballistic grade materials to manufacture the armor plates, the wearer must still bear the physical weight of the armor vest while maintaining combat effectiveness.

Armor vests provide several Velcro side and shoulder straps to maintain the positioning of the armor vest on the wearer. In use, whether or not in combat, and while, at times, having secured to it pouches, packets, grenades, and other devices, the armor vest submits to gravity and tends to slide downwards along the torso of the wearer. Under these circumstances, the weight of the armor vest, and all that is attached to it, bears on the shoulders, neck and back of the wearer. While there are clear advantages to wearing body armor in armor vests, the armor vest may cause discomfort and even neck, shoulder, and back injury due to its weight.

Accordingly, there is a present need for a weight distribution and support device and system for armor vests that redistributes the weight of the vest off of the shoulders of a wearer. There is also a present need for a weight distribution and support device and system for armor vests that reduces discomfort and injury to the wearer. Furthermore, there is a need to provide a weight distribution and support device and system for armor vests that promotes the venting of body heat of the wearer during use of the armor vest.

SUMMARY OF THE INVENTION

The present provides devices and systems for supporting the weight of an armor vest on the wearer of the vest. The weight of the armor vest is distributed by way of the devices and systems of the present invention off of the wearer's shoulders and neck to his or her hips.

A load distribution device for an minor vest is provided with the present invention. The load distribution device comprises a flexible back brace secured to a back portion of the armor vest; a belt; a coupling, wherein the coupling attaches the belt to the back portion of the armor vest adjacent a lower portion of the flexible back brace; and strap supports, wherein the strap supports slideably connect a front portion of the armor vest to the back portion of the armor vest through a ring-like device.

According to the present invention, a flexible back brace is provided and comprises a flat body having two arms. The flexible back brace may comprise a flat y-shape or other suitable shape for supporting and distributing the weight of an armor vest.

According to the present invention, a belt is provided and comprises a rigid support with a housing having a belt attachment mechanism for attachment to the back portion of the armor vest.

According to the present invention, an attachment mechanism is provided and may comprise at least one strap and a plurality of horizontally configured straps, such as MOLLE. The at least one strap may be used to connect the belt attachment mechanism to a vest attachment mechanism. Alternative forms of attachment may be implemented to attach the belt to the armor vest so long as the attachment mechanism allows for partial movement of the armor vest in relation to the belt.

According to the present invention, strap supports are provided and comprise at least two straps. A first end of each strap may be connected to a front portion of the armor vest and pass through at least one ring attached to a back portion of the armor vest and wrap around a side of the armor vest. Each strap may comprise a clasp for removeably attaching each strap to the front portion of the armor vest. Each strap is provided to create a cinch fit between the front portion and the back portion of the armor vest.

An armor vest is provided by the present invention and comprises a load bearing device for supporting the weight of the armor vest; and a waist belt for redistributing the weight of the armor vest transmitted through load bearing device, wherein the waist belt is attached through an attachment interface to a back portion of the armor vest.

According to the present invention, a load bearing device is provided and comprises a flexible flat support positioned within a back portion of the armor vest. The load bearing device comprises a rigid, yet flexible, body for supporting and transmitting weight of the armor vest.

According to the present invention, at least two straps are provided to connect a front portion of the armor vest to a back portion of the armor vest. Each strap slideably passes through at least one ring attached to the back portion of the armor vest. Each strap is slideably positioned within a corresponding passage of a side panel, or cummerbund, of the armor vest. Each strap may comprise a clasp connected to a securement strap attached to the front portion of the armor vest. Each strap is slideably positioned within a corresponding sleeve attached to the back portion of the armor vest, and wherein each strap comprises an upper lock and a lower lock.

A load bearing weight distribution device is provided with the present invention and comprises a back brace; a waist belt, wherein the waist belt is connected through a housing to back brace; and a vertical and circumferential tensioning mechanism.

According to the present invention, a back brace is provided and comprises a flexible body with arms.

According to the present invention, vertical and circumferential securement mechanism is provided and comprises a first securement strap and a second securement strap.

According to the present invention, the load bearing weight distribution device is used in connection with an armor vest. A first securement strap connects an upper front portion of the armor vest through a first channel and a first ring of the back portion and through a first passage of the armor vest for attachment to a securement device positioned on a lower front portion of the armor vest. A second securement strap connects an upper front portion of the armor vest through a second channel and a second ring of the back portion and through a second passage of the armor vest for attachment to a securement device positioned on a lower front portion of the armor vest.

In an embodiment, the straps may have locks comprising strap or other material that functions to stop excessive slippage of the straps through strap lock sleeves attached to the back portion of the armor vest.

The armor vest harness provides an ergonomic, safety, and venting function to maintain the weight of the armor vest off of the shoulders of a wearer of the armor vest.

DESCRIPTION OF THE EMBODIMENTS OF THE INVENTION

Figure 1:
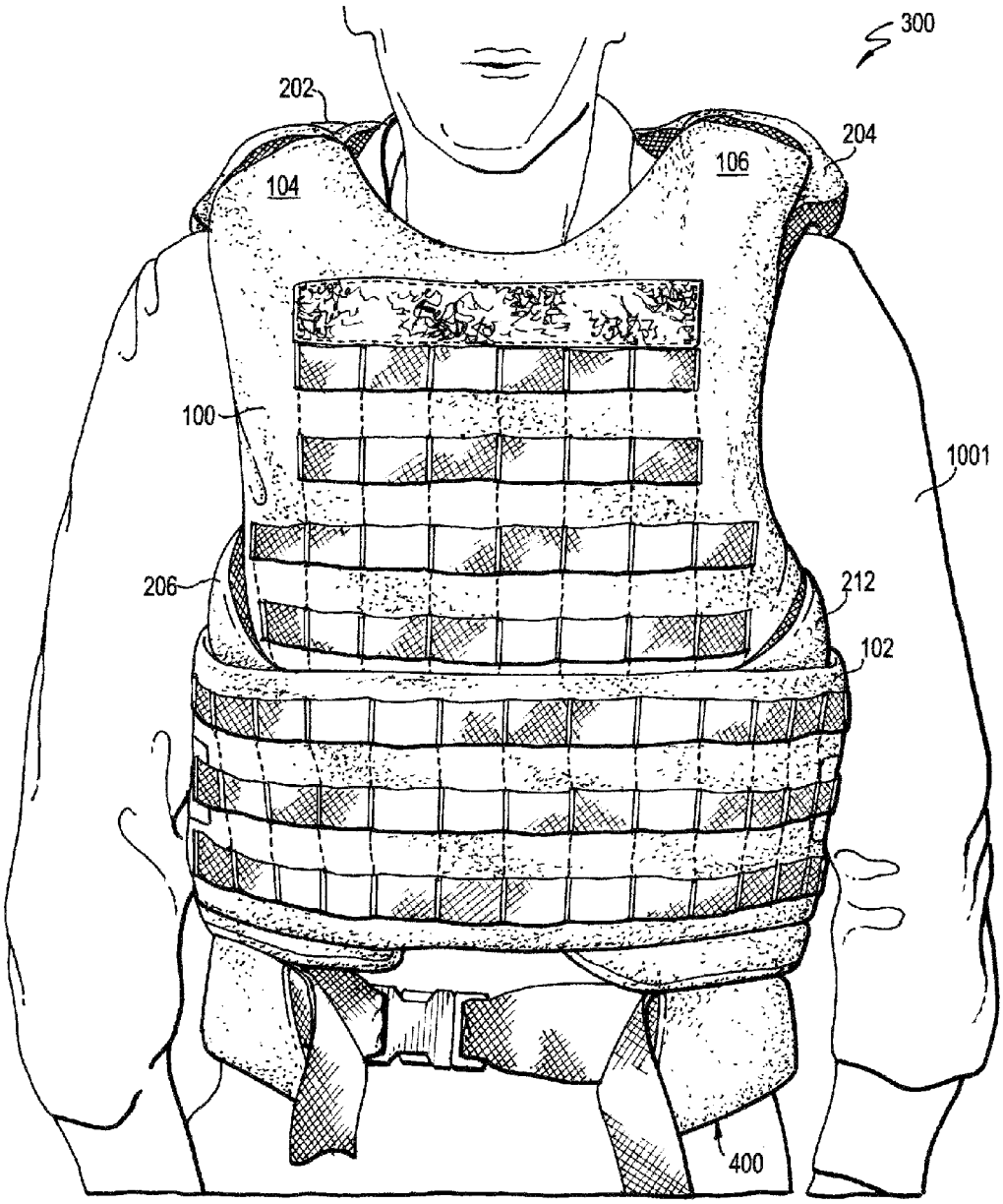
FIG. 1 shows an outer view of a front portion of an armor vest having a weight distribution and support device and system of the present invention.

Understanding of the present invention will be facilitated by consideration of the following detailed description of embodiments of the present invention taken in conjunction with particular embodiments as described in the accompanying written description and the figures. It is to be understood that the figures and descriptions of the present invention have been simplified to illustrate elements that are relevant for a clear understanding of the present invention.

Referring generally now to FIGS. 1-16 in which like reference characters refer to like parts throughout the several views thereof, an armor vest support device and system is provided according to the present invention. The armor vest support device and system comprises back brace 310, belt 400, and strap support 500 for distributing the weight of an armor vest 300 away from, and from bearing down on, the shoulders of wearer 1001, as shown throughout various views in the figures.

Back brace 310 in relation to armor vest 300 provides structural support for bearing at least a portion of the weight of armor vest 300 and distributing the weight to belt 400.

Strap support 500 provides structure to support the distribution of weight of the armor vest 300 to belt 400. Strap support 500 also provides the mechanism for adjusting the fit of armor vest 300 around the torso of wearer 1001 and creating a comfort fit of armor vest 300.

The present invention also provides for venting the body heat of a wearer 1001 during use of armor vest 300.

Referring generally to FIGS. 1-16, armor vest 300 and its components are shown for illustrative purposes only and in now way limit the application of the present invention solely to the illustration of the type and style of armor vest 300 shown. Armor vest support device and system of the present invention may be used in connection with any style and form of minor vest, similar body armor system, or pack for use to provide a level of protection to the torso of wearer 1001.

Figure 2:
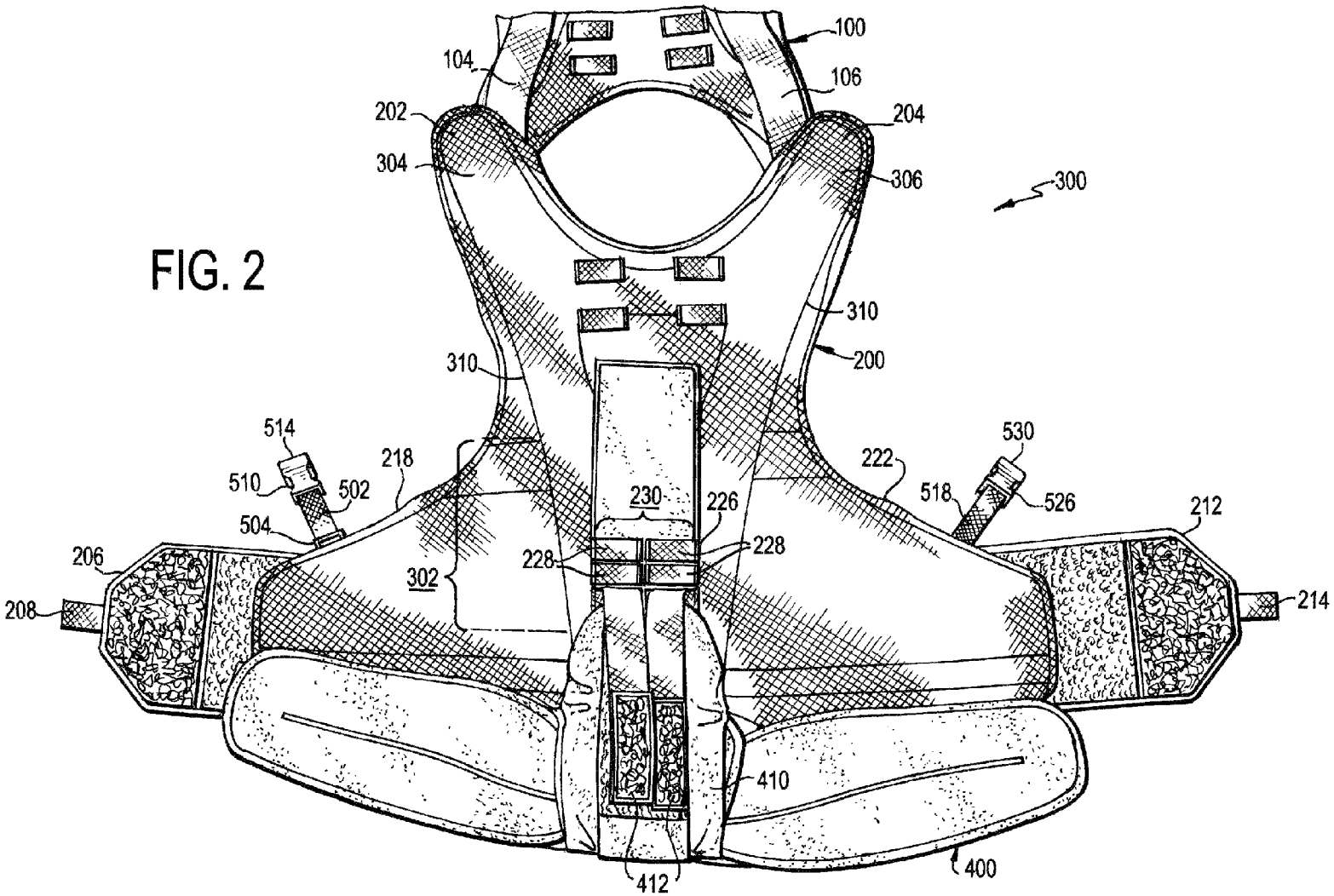
FIG. 2 shows an inner view of a rear portion of the armor vest having the weight distribution and support device and system of the present invention.
Figure 3:
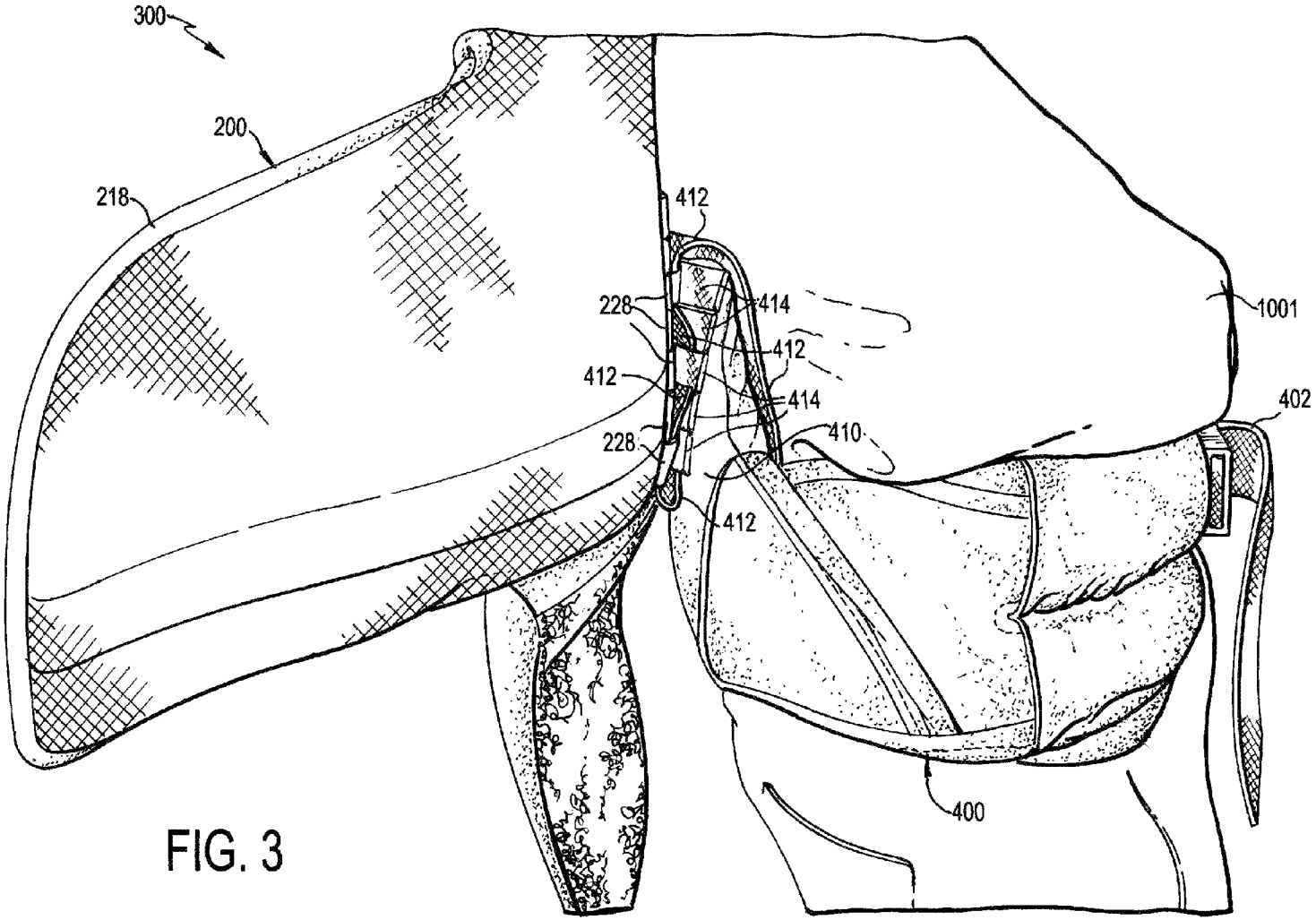
FIG. 3 shows a side perspective view of a belt attached to an inside of the rear portion of the armor vest.
Figure 4:
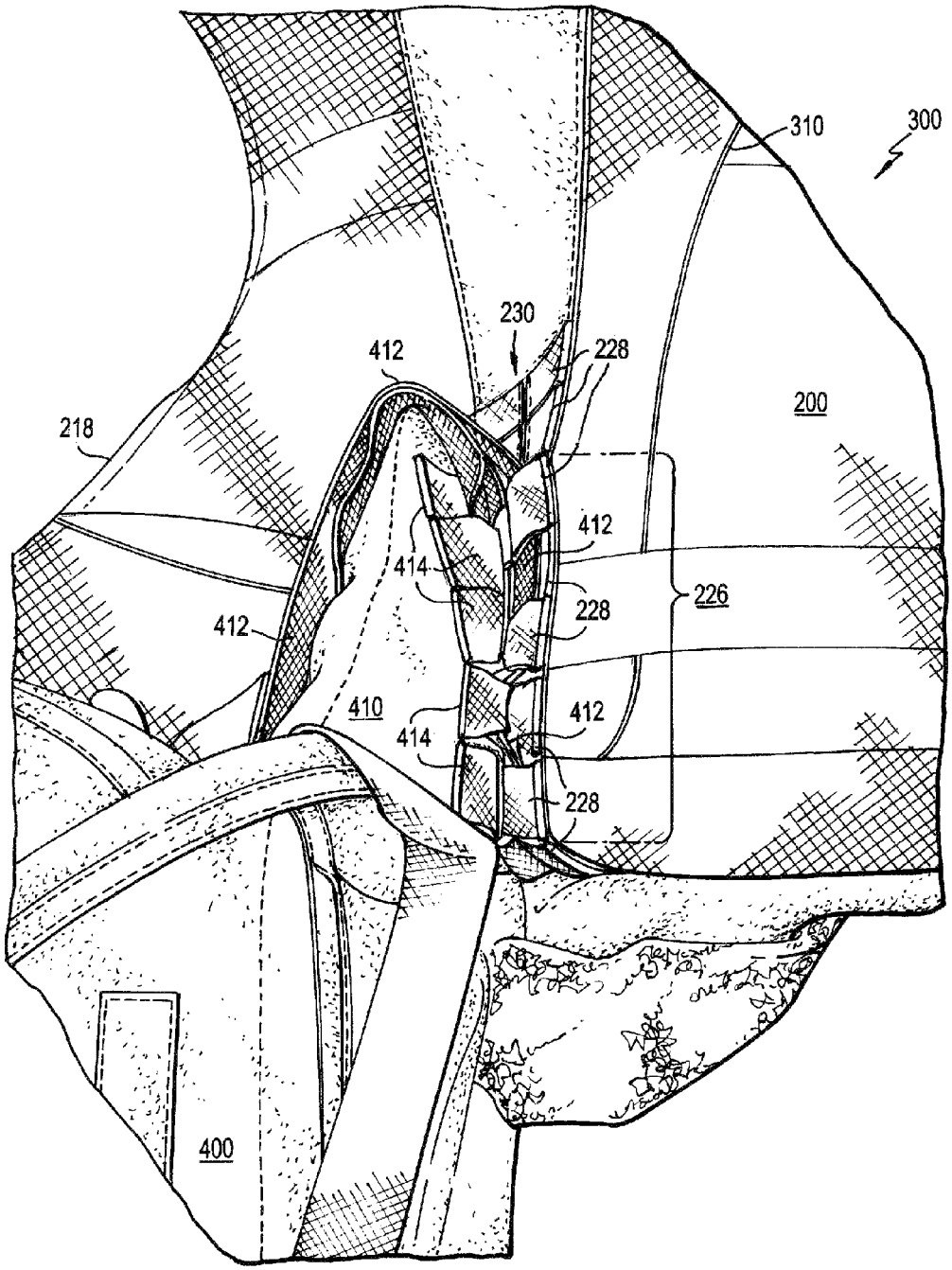
FIG. 4 shows another side perspective view of the belt attached to the inside of the rear portion of the armor vest.
Figure 5:
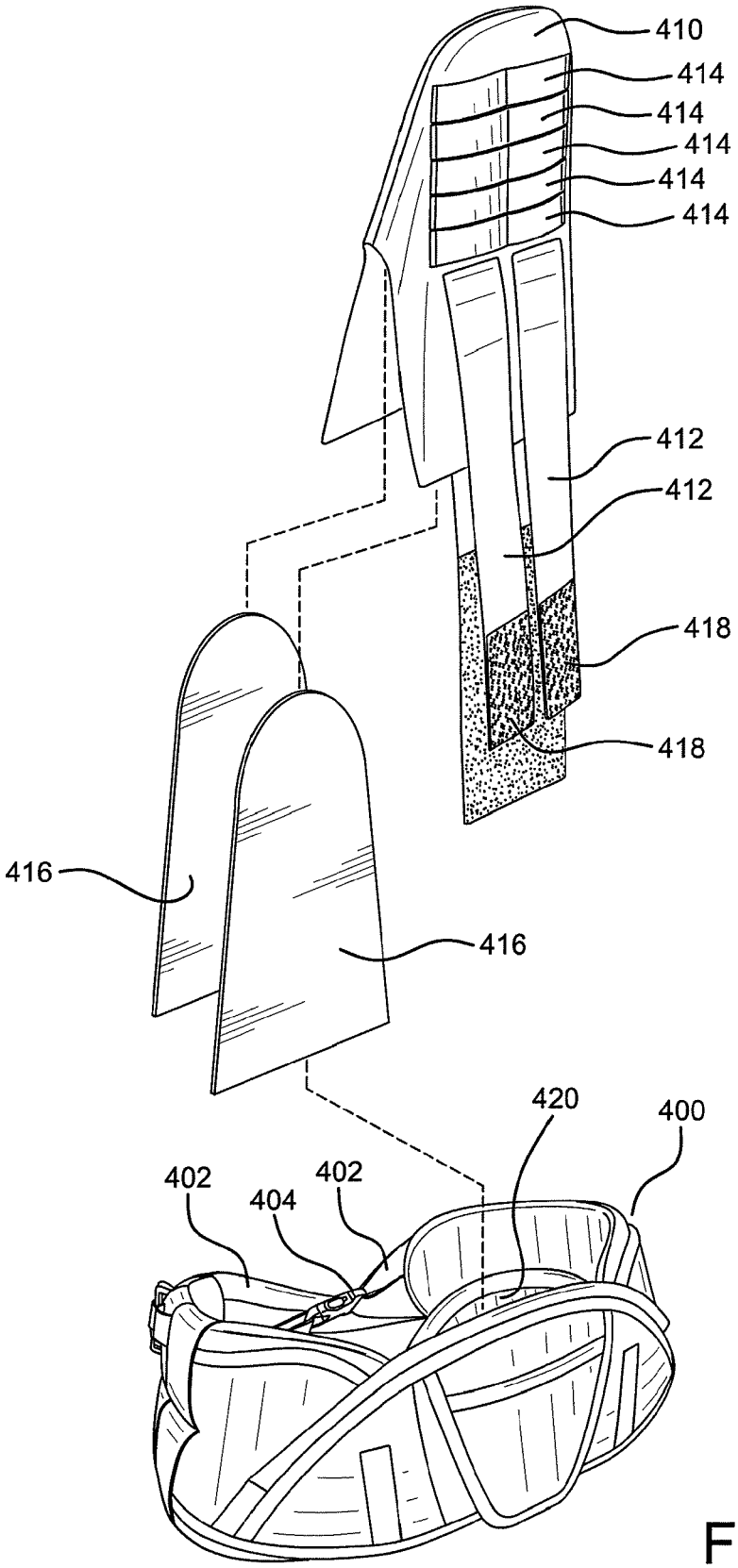
FIG. 5 shows an exploded view of the belt, an interface housing, and an interface rigid support of the present invention.
Figure 6:
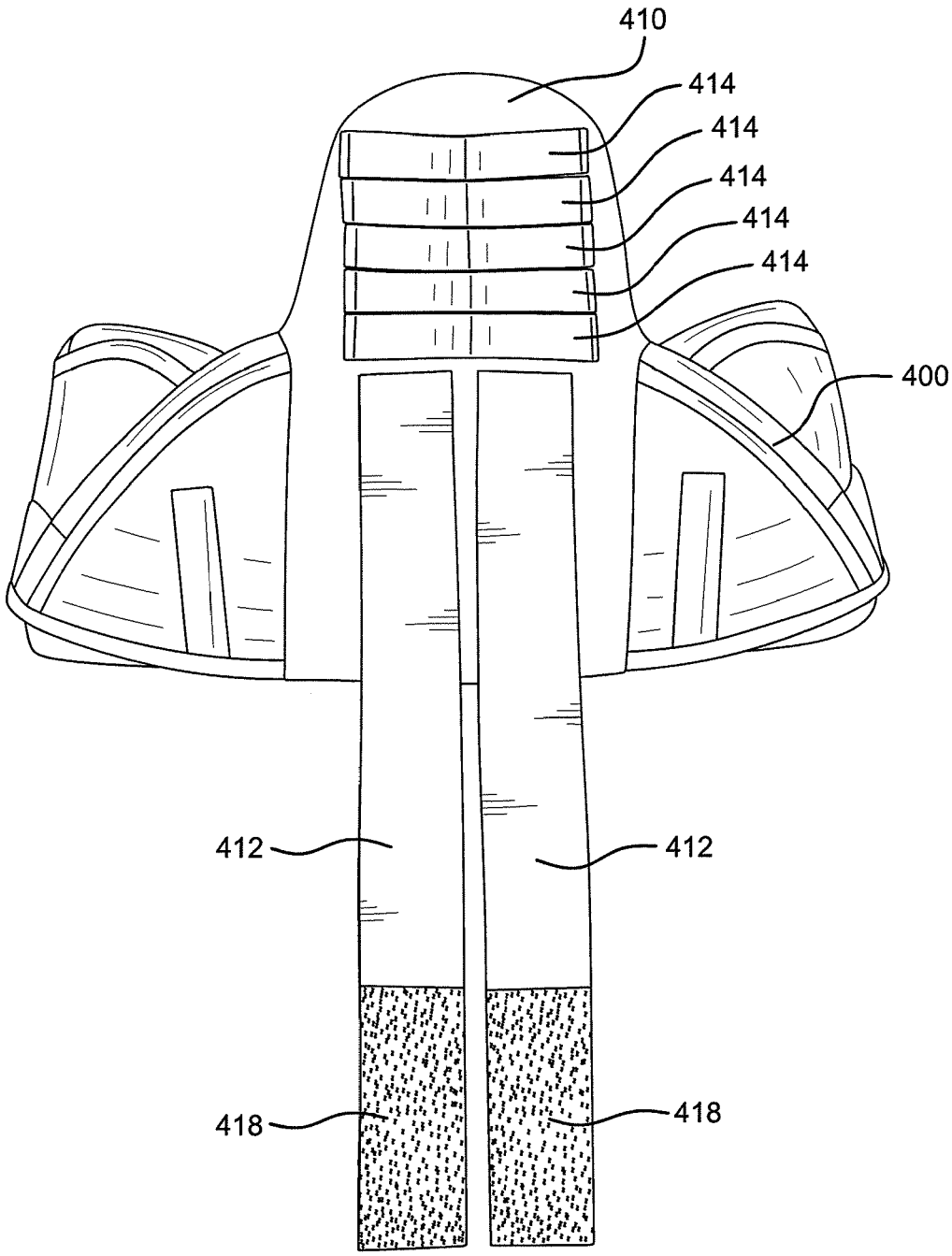
FIG. 6 shows a rear view of the interface housing of the present invention.
Figure 7:
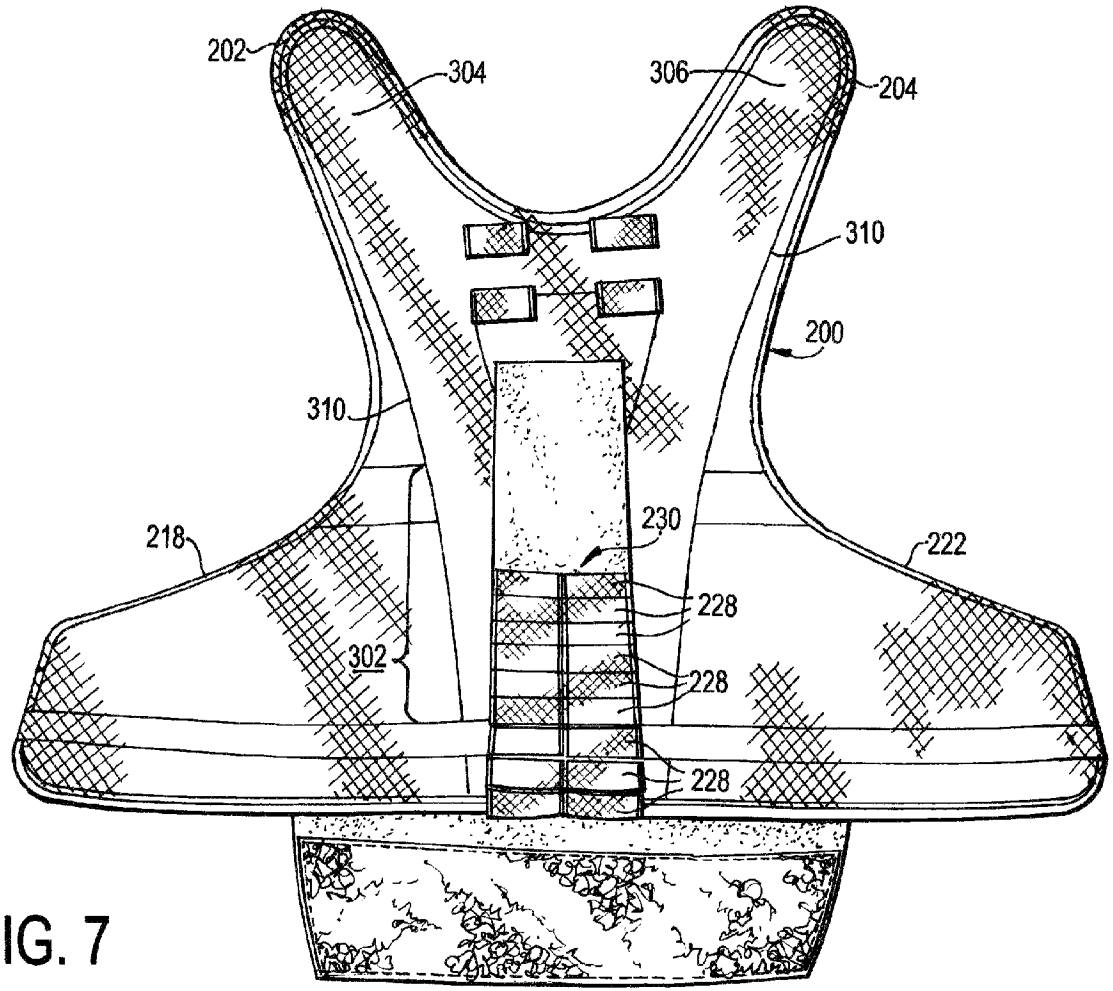
FIG. 7 shows a view of the inside of the rear portion of the armor vest of the present invention.

Referring to FIGS. 2, 4, and 7, back brace 310 is provided in relation to rear portion 200 of armor vest 300. Back brace 310, which may or may not be integrated within rear portion 200 of armor vest 300, comprises a flexible yet partially rigid structure that facilitates support and redistribution of the weight of armor vest 300. Shown more particularly in FIGS. 2 and 7, back brace 310 is generally a flat structure having a main body 302 with first arm 304 and second arm 306 that extend away from main body 302. Main body 302 is shown integrated within rear portion 200 of armor vest 300 to be positioned adjacent and extend along at least the lumbar and at least a portion of the thoracic vertebrae of wearer 1001. First arm 304 and second 306 extend laterally and, possibly also, vertically away from main body 302 of back brace 310. Back brace 310 may be generally symmetrical and may take on a y-shape or other suitable geometric shape for supporting the weight of an armor vest. First arm 304 and second arm 306 is shown integrated within rear portion 200 of armor vest 300 to be positioned adjacent and extend along at least part of the scapular and shoulder region of wearer 1001. Additional support may be positioned between first arm 304 and second arm 306 to lend support to maintain the flexibility and rigidity of back brace 310.

Referring to FIGS. 2, 4, and 7, back brace 310 may be positioned between an outer layer of material and an inner layer of material of rear portion 200 of armor vest 300. Optionally, single or multiple layers of soft ballistic packs or materials may be provided between an outer layer of material and an inner layer of material of rear portion 200 of armor vest 300. Back brace 310 may be positioned between an inner layer of material of rear portion 200 of armor vest 300 and single or multiple layers of soft ballistic packs or materials of armor vest 300.

Back brace 310, shown particularly in FIGS. 2, 4, and 7, may comprise any flexible and rigid material suitable for supporting the weight of armor vest 300 while wearer 1001 is used armor vest 300 for training, combat, or any other use. For example, and not as a limitation, back brace 310 may comprise any one of plastic, polymeric, metal, rubber, polymer, fiberglass, graphite, ballistic grade material, synthetic and natural material, or other suitable material possessing sufficient density and sufficient tensile and torsional strength to withstand the various types of force placed on back brace 310 during use with armor vest 300, or any combinations thereof. The materials must provide a structure sufficiently flexible, yet rigid enough, for weight support and distribution of armor vest 300.

Referring now to FIGS. 2-6, back brace 310 may be affixed to rear portion 200 of armor vest 300. As an example, affixation may occur through belt attachment interface 226 provided along a front surface of rear portion 200. Belt attachment interface 226 may comprise material attached, or affixed to, front surface of rear portion 200. Belt attachment interface 226 provides a mechanism to attach rear portion 200 of vest 300 to belt 400. The attachment provided by belt attachment interface 226 must allow movement to accommodate some lateral, torsional, bending, and compression force so that rear portion 200 of armor vest 300 may have a flexible interaction with belt 400 and provide wearer 1001 the ability to move while wearing armor vest 300.

For example, and not as a limitation, as shown in FIGS. 2-6, belt attachment interface 226 may comprise strap panel 230 comprising a plurality of horizontally positioned horizontally configured straps, such as MOLLE 228. MOLLE 228 provides communications for receiving interface attachment straps 412 of belt 400, straps, or other securement mechanism to be interwoven or otherwise secure MOLLE 228 of belt attachment interface 226 provided along rear portion 200 of armor vest 300 and MOLLE 414 of interface housing 410 of belt 400 as shown more particularly in FIGS. 3 and 4.

Referring now to FIGS. 2-6, 9, and 11-16, armor vest support device and system also comprises belt 400. As previously and generally discussed in an embodiment, belt 400 is configured to interface with, and be secured to, belt attachment interface 226 of rear portion 200 of armor vest 300. Belt 400 comprises belt straps 402 which may be used to secure belt 400 around the waist of wearer 1001 by way of belt strap clasps 404. Belt straps 402 may adjusted for comfort by wearer 1001 by pulling the free ends of belt straps 402 away from belt strap clasps 404 when secured.

Referring to FIGS. 2-6, also provided with belt 400 is interface housing 410 which wraps around the central rear portion of belt 400. Interface housing 410 may be tightly secured to itself or to belt 400 with Velcro or other securement mechanism, such that interface housing 410 wraps around belt 400 and encloses and secures in place interface rigid support 416 in a receiving space 420 for said interface rigid support in belt 400. Interface rigid support 416 provides rigid support for interface housing 410 to provide structural support between belt 400 and MOLLE 414 along interface housing 410. Alternative forms of interface rigid supports may be used to connect belt 400 to armor vest 300.

Referring to FIGS. 2-6, interface attachment straps 412 are provided with interface housing 410. Interface attachment straps 412 are used to secure belt 400 to rear portion 200 of armor vest 300 by way of being interwoven through corresponding and alternating communications of MOLLE 228 and MOLLE 414 as shown particularly in FIGS. 3 and 4. MOLLE 228 and MOLLE 414 provide for vertical adjustment of interface housing 410, and incidentally, belt 400 relative to rear portion 200 of armor vest 300 to fit the physical stature of wearer 1001.

Alternative structures may be used to attached interface housing 410 to rear portion 200 of armor vest 300 so long as belt 400 and rear portion 200 of armor vest are permitted some level of movement.

Shown throughout FIGS. 2, 4, and 7, back brace 310 provides for dynamic weight redistribution of armor vest 300 off of the shoulders of wearer 1001 to the hips of wearer 1001 through the connection of back brace 310 to belt 400 while the system is in use.

Referring now to FIGS. 8-13, armor vest support device and system also comprises strap support 500. Strap support 500 comprises first strap 502 and second strap 518 which connect on their free ends to securement strap 600 positioned along front portion 100 of armor vest 300. Strap support 500 synergistically with back brace 310 provides support for redistribution of the weight of armor vest 300 to belt 400.

Referring again to FIGS. 8-13, first strap 502 and second strap 518 of strap support 500 connect front portion 100 of armor vest to rear portion 200 of armor vest. A first end of first strap 502 may be connected to first strap connection 110, or other aspect, of front portion 100 of armor vest 300 by way of a connection device as shown specifically in cutaway view A of FIG. 8. First strap 502 extends along the upper back surface of rear portion 200 of armor vest 300 through first strap channel 234 shown in FIGS. 8 and 9.

Figure 9:
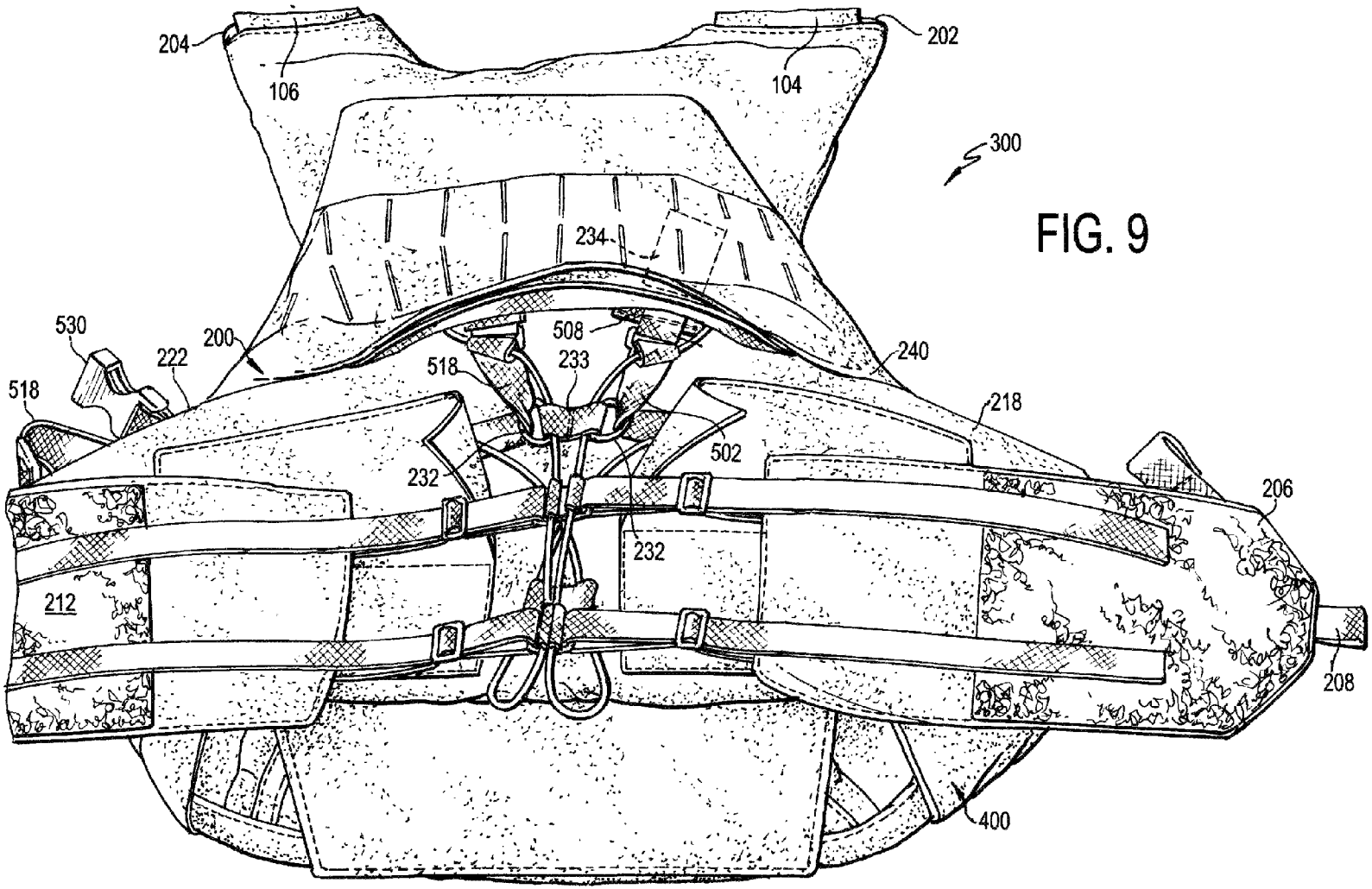
FIG. 9 shows a bottom, rear perspective view of an interior portion of the rear portion of the armor vest having the weight distribution and support device and system of the present invention.
Figure 10:
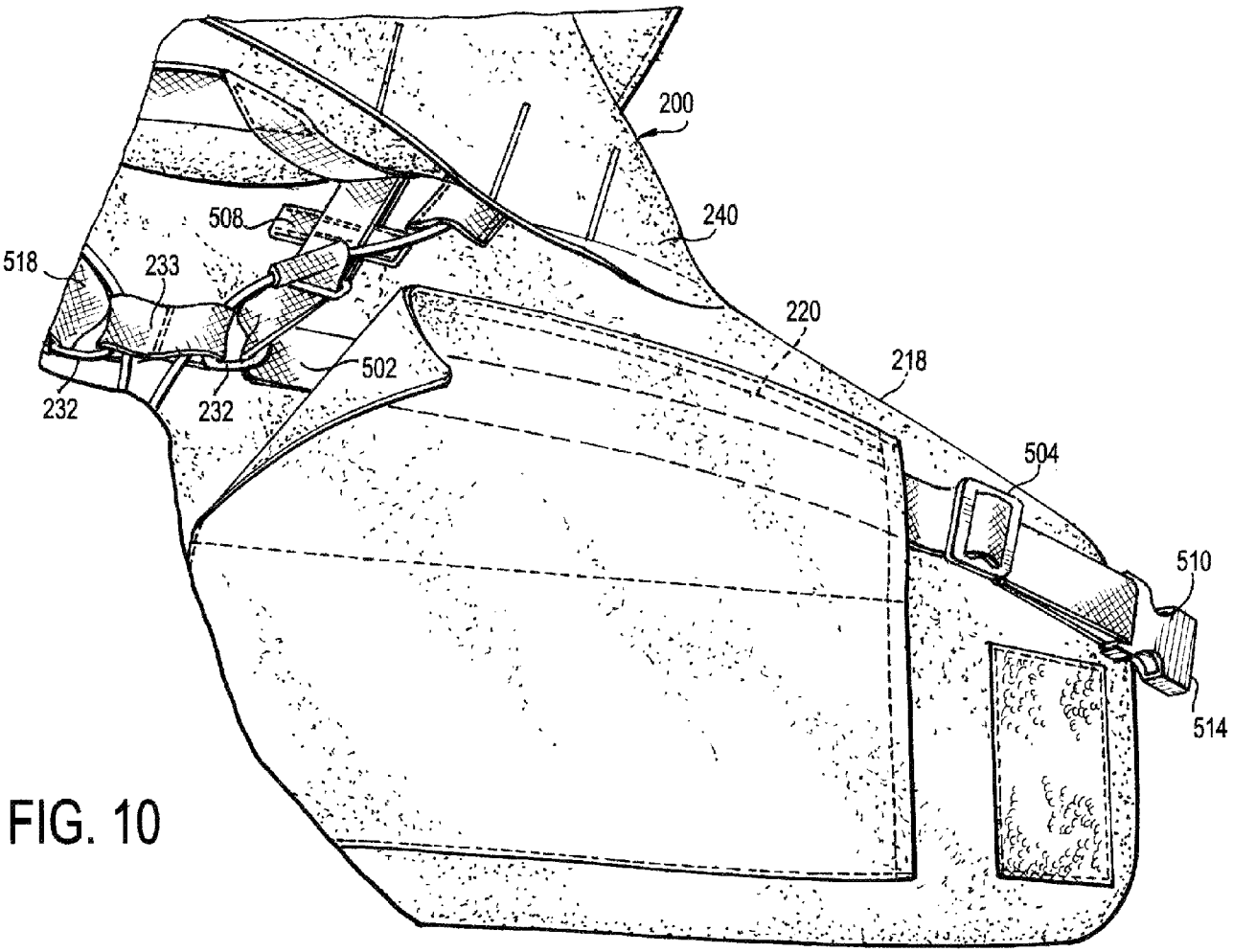
FIG. 10 shows a partial view of the interior portion of the rear portion of the armor vest having the weight distribution and support device and system of the present invention.
Figure 11:
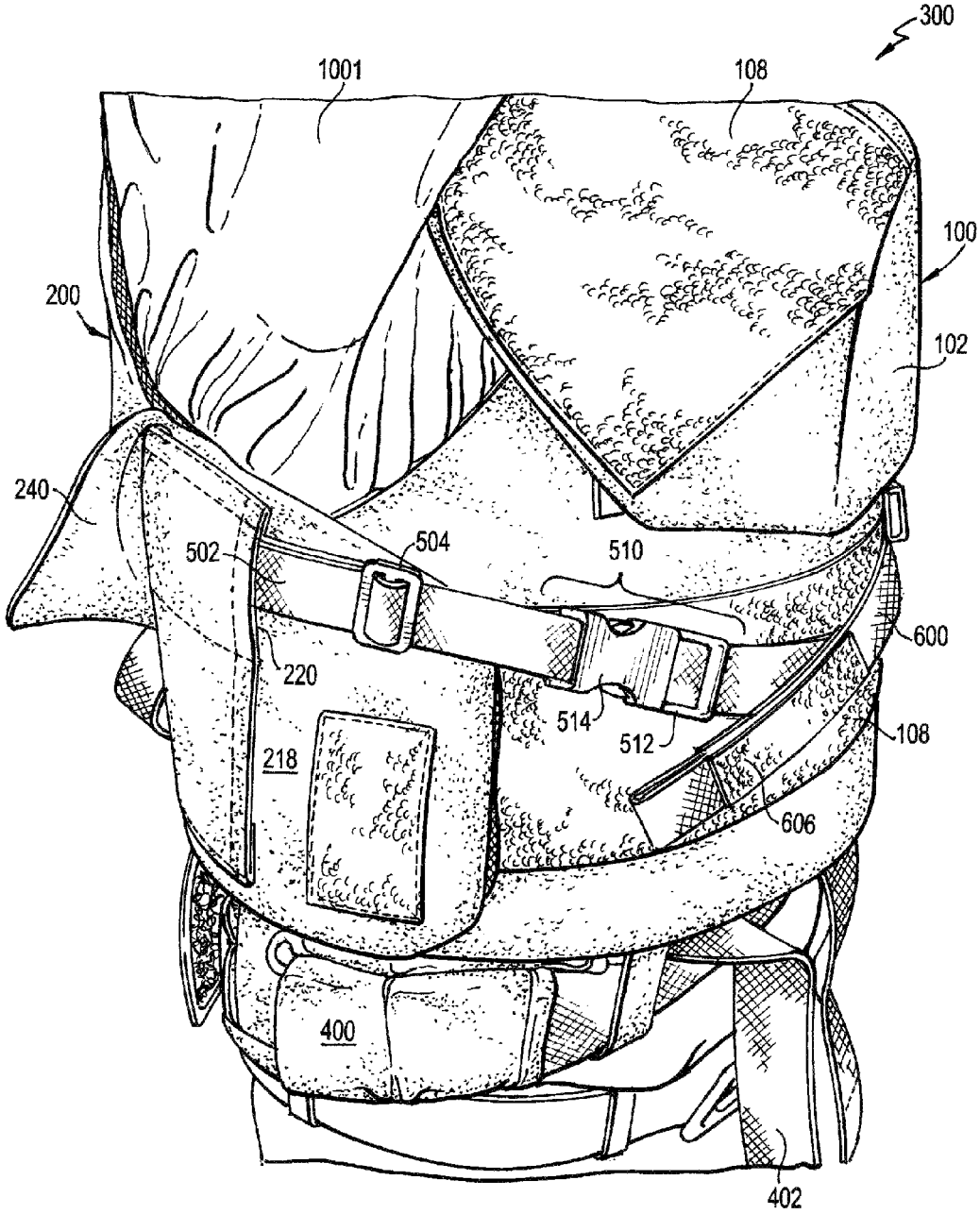
FIG. 11 shows a side perspective view of the armor vest having the weight distribution and support device and system of the present invention.

Additionally first strap 502 extends further down the lower back surface of rear portion 200 of armor vest 300 and is redirected by and through D-ring 232 shown in FIGS. 9 and 10, which is attached to rear portion of vest with D-ring attachment 233, toward and along first side portion 218 of rear portion 200 of armor vest 300 shown in FIGS. 9-11. After redirection through D-ring 232, first strap 502 passes through first passage 220 provided through first side portion 218 of rear portion 200 of armor vest 300. First passage 220 is provided under and along a piece of material attached to the surface of first side portion 218 of rear portion 200. First strap clasp 510 is provided to connect the free end of first strap 502 to securement strap 600. First strap clasp 510 comprises female end 514 attached to the free end of first strap 502 and male end 512 adjustable attached to securement strap 600.

Likewise, and as shown generally in FIGS. 9-11, a second end of second strap 518 may be connected to second strap connection 112, or other aspect, of front portion 100 of armor vest 300 by way of a connection device. Second strap 518 extends along the upper back surface of rear portion 200 of armor vest 300 through second strap channel 236.

Additionally second strap 518 extends further down the lower back surface of rear portion 200 of armor vest 300 and is redirected by and through D-ring 232, again as shown in FIGS. 9-10, which is attached to rear portion of vest with D-ring attachment 233, toward and along second side portion 222 of rear portion 200 of armor vest 300. After redirection through D-ring 232, second strap 518 passes through second passage 224 provided through second side portion 222 of rear portion 200 of armor vest 300. Second passage 224 is provided under and along a piece of material attached to the surface of second side portion 222 of rear portion 200. Second strap clasp 526 is provided to connect the free end of second strap 518 to securement strap 600. Second strap clasp 526 comprises female end 530 attached to the free end of second strap 518 and male end 528 adjustable attached to securement strap 600.

Figure 8:
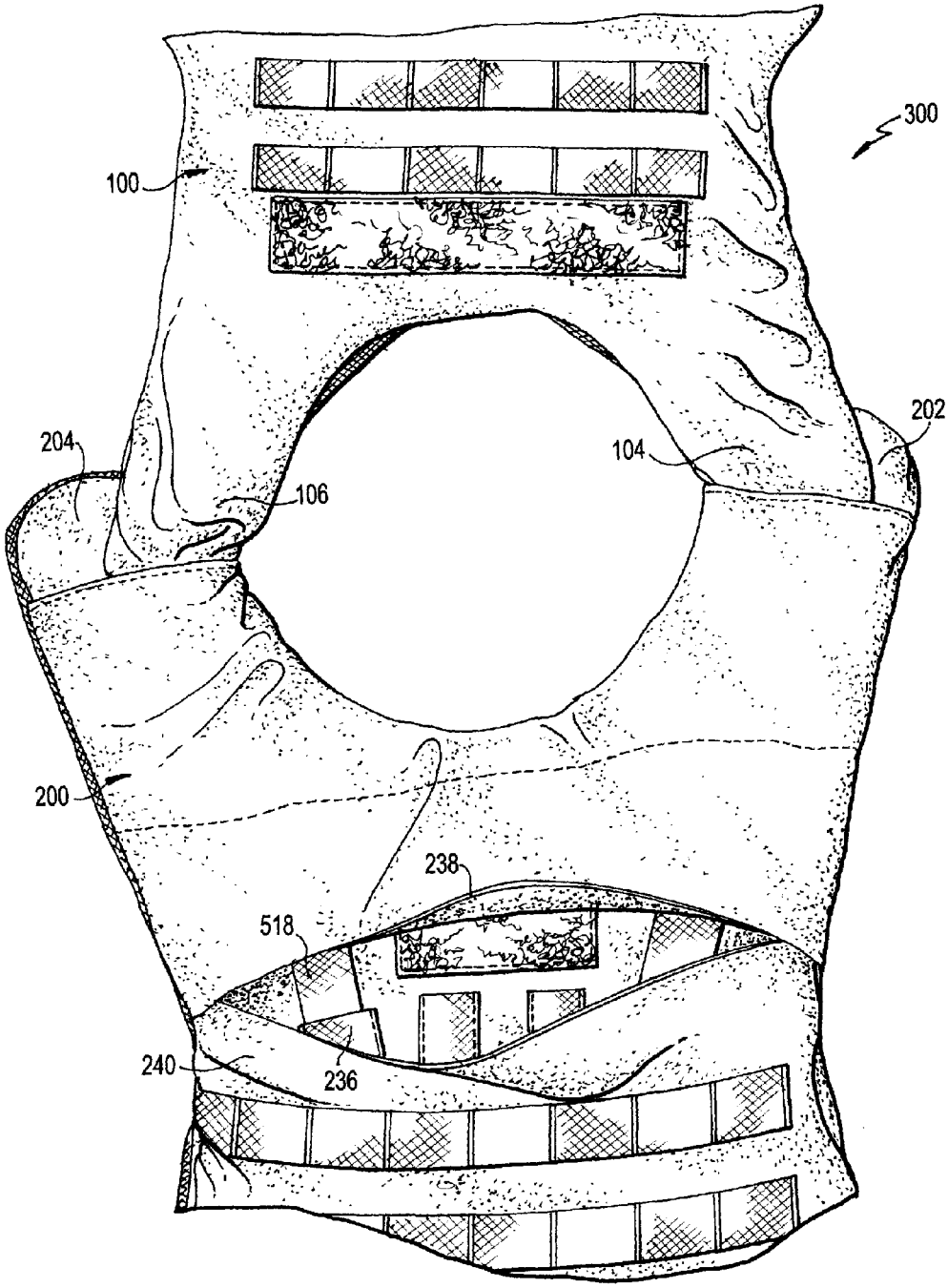
FIG. 8 shows another outer view of the front portion of the armor vest of the weight distribution and support device and system of the present invention.
Figure 8A:
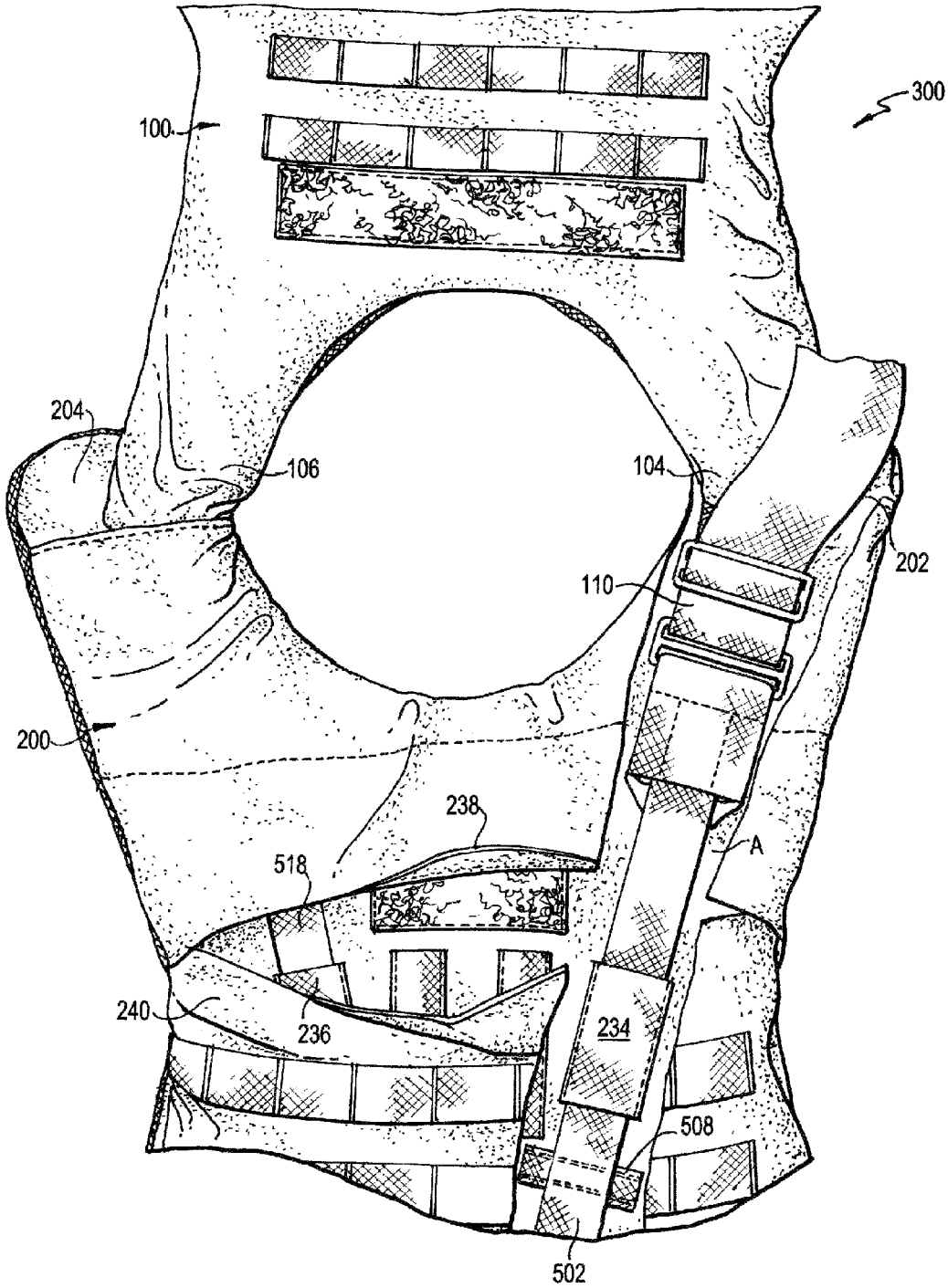
FIG. 8A shows another outer view of the front portion of the armor vest showing a cutaway A of the weight distribution and support device and system of the present invention.

Referring now to FIGS. 8-10, strap support 500 is covered, in part, along rear portion 200 of armor vest 300 by upper cover 238 and lower cover 240 attached to rear portion 200 of armor vest 300.

Figure 12:
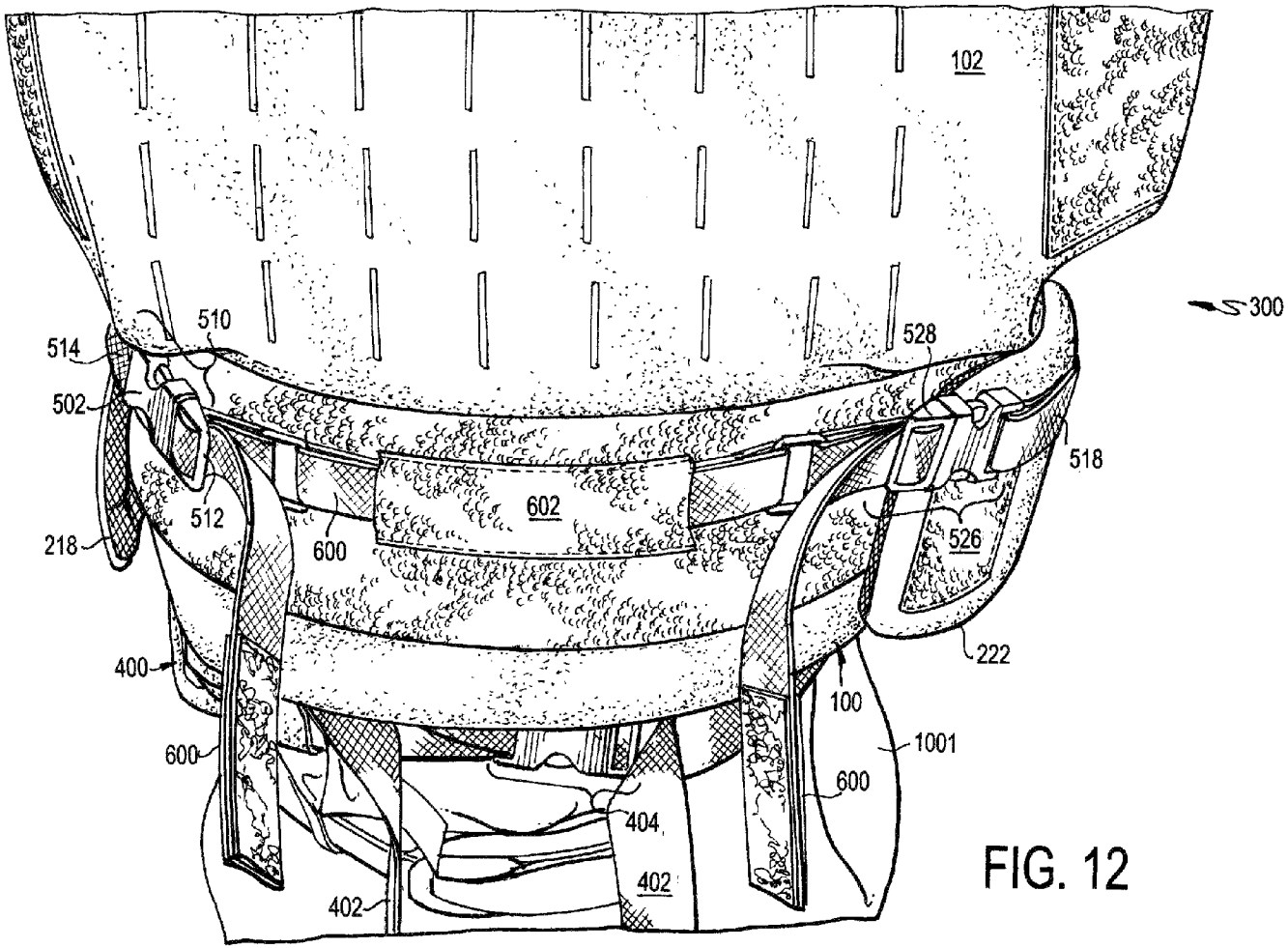
FIG. 12 shows a front perspective view of the armor vest with the flap open.
Figure 13:
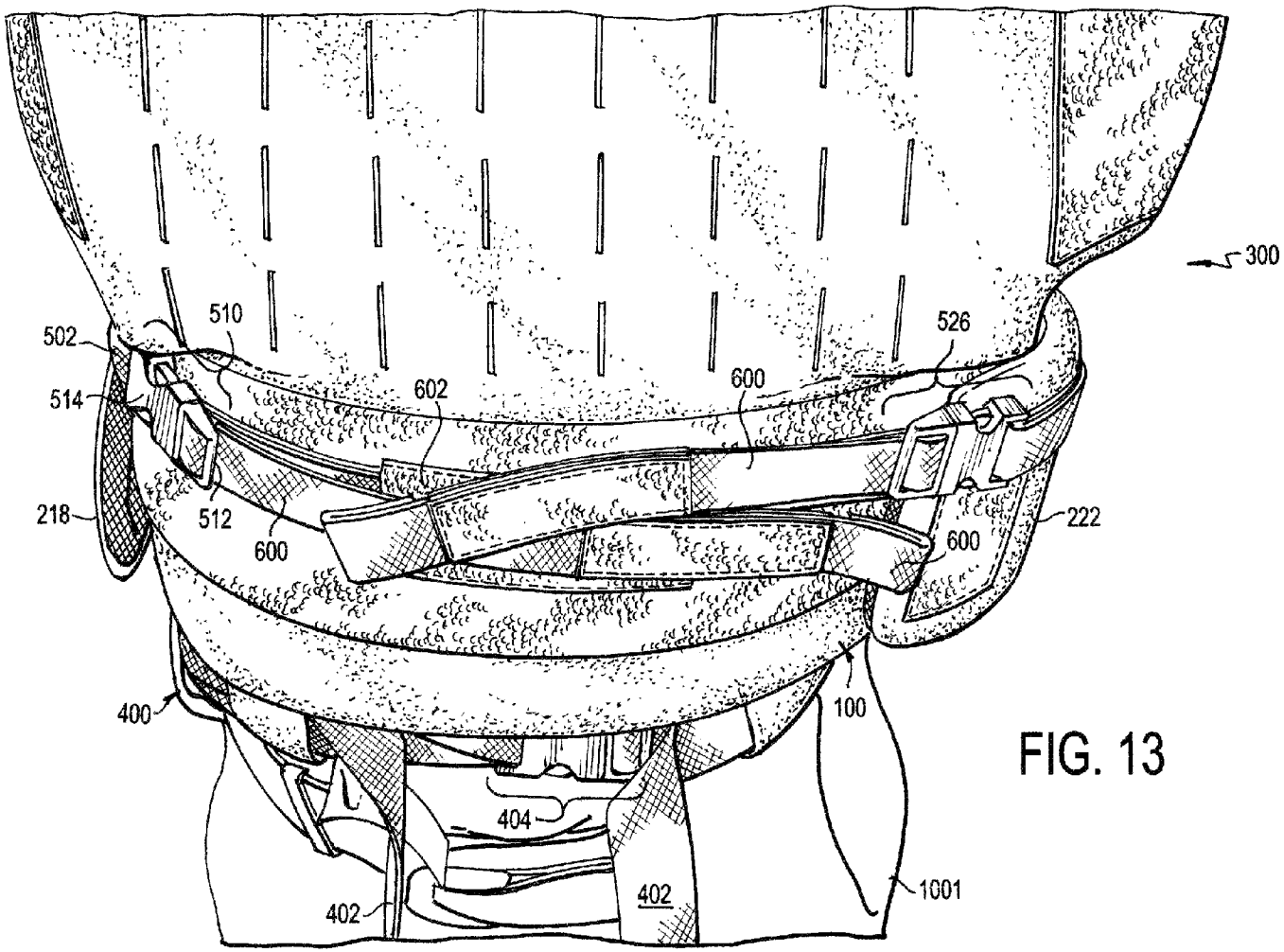
FIG. 13 shows another front perspective view of the armor vest with the flap open.

Referring now to FIGS. 11-13, free ends of securement strap 600 serve as pulls to adjust and tighten the tension on strap support 500. Velcro may be provided along the surface of free ends of securement strap 600 to provide removeable attachment to corresponding Velcro provided along the front of front portion 100 of armor vest 300. The central portion of securement strap 600 positioned within a horizontally configured communication provided by housing 602. Velcro provided along the underside of first side panel 206 and the underside of second side panel 212 engages the corresponding Velcro provided along the front of front portion 100 of armor vest 300 and the Velcro provided along the outer surface of the free ends of securement strap 600.

Referring now to FIGS. 11-15, flap 102 is provided along front portion 100 of armor vest 300. Velcro is provided along the rear surface of flap 102, which engages corresponding Velcro provided along the outer side of first side panel 206 and the underside of second side panel 212 attached by straps to rear portion 200 of armor vest 300.

Figure 16:
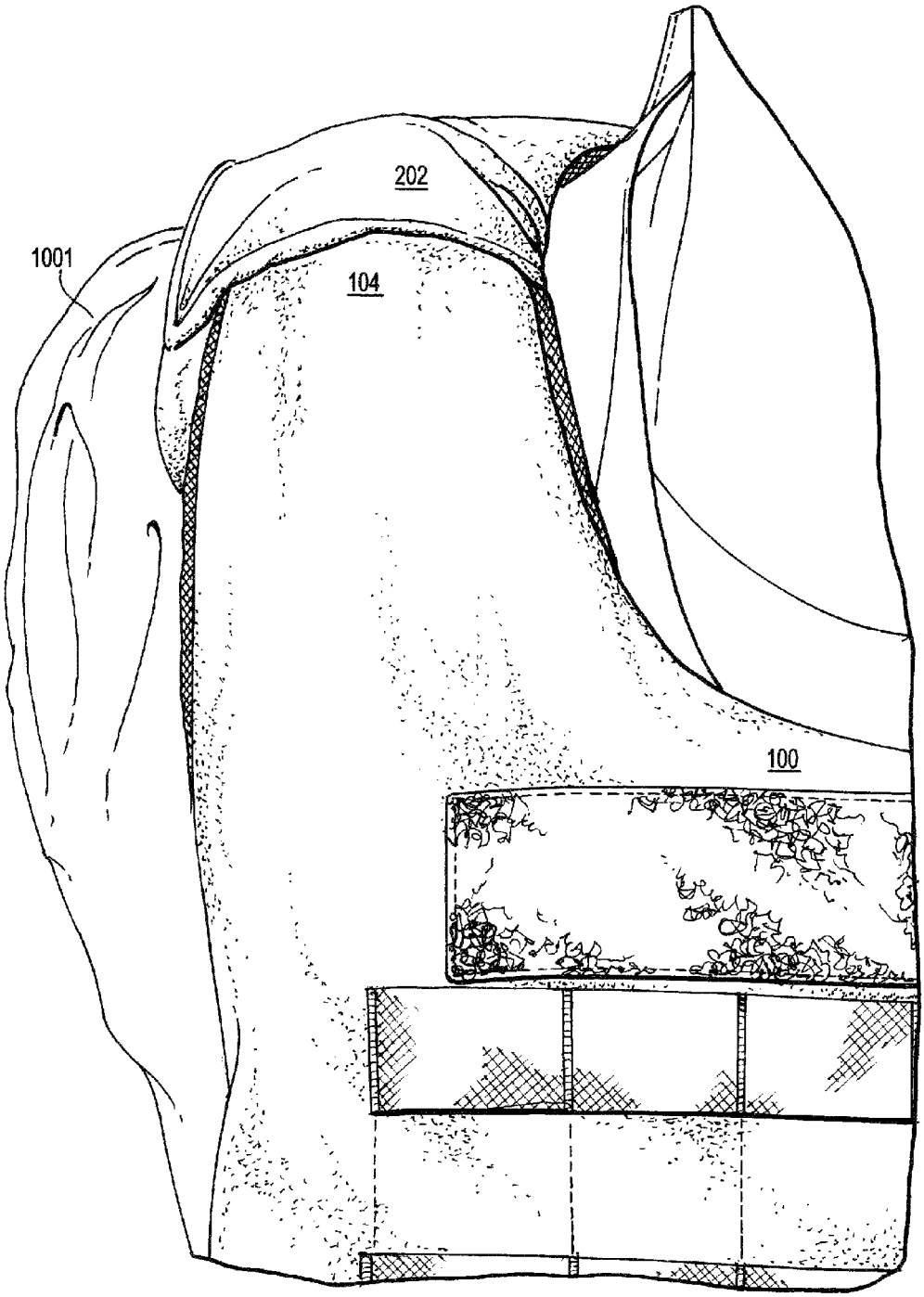
FIG. 16 shows a front view of the armor vest.

Armor vest 300 having armor vest support device and system, as shown throughout the various figures, is donned similar to other armor vests. Here, and as shown in FIGS. 1, 2, and 16, the head of wearer 1001 may be positioned through the space created between the top and first shoulder part 104 and second shoulder part 106 of first portion and the top and first shoulder portion 202 and second shoulder portion 204 of rear portion 200 of armor vest 300. Rear portion 200 rests adjacent the back of wearer 1001 and front portion 100 rests adjacent the front of wearer 1001. Flap 102 of front portion 100 of armor vest 300 is placed in an upward position.

Next, and as shown in FIGS. 11-15, belt strap clasps 404 of belt 400 are attached and belt straps 402 are used as pulls to tighten and cinch belt 400 to a comfort fit adjacent the hips of wearer 1001. First side portion 218 and second side portion 222 of rear portion 200 of armor vest 300 are position adjacent the sides of wearer 1001 so that female end of first clasp 514 engages male end first clasp provided with securement strap 600 as shown in FIGS. 11-12. Likewise, female end of second clasp 530 engages male end of second clasp provided with securement strap 600. First side panel 206 and second side panel 212 remain hanging along the rear of armor vest 300.

Free ends of securement strap may then be pulled to adjust the tension of first strap 502 and second strap 518 and tighten strap support 500 as shown in FIGS. 11-13. The tightening of strap support 500 performs two key functions. First, it pulls front portion 100 of armor vest upwards along the shoulder region of wearer by way of the force exerted on the first strap 502 connected to first strap connection 110 attached to first shoulder part 104, and concurrently, on the second strap 518 connected to second strap connection 112 attached to second shoulder part 106, both of front portion 100 of armor vest 300.

Second, and as strap support 500 may be tightened, front portion 100 and rear portion 200 are tightened around the torso of wearer 1001 generally along the front, side and rear circumferential surface of armor vest 300. This, in turn, lifts the weight of armor vest 300 off of the shoulders of wearer 1001 and redistributes the weight onto back brace 310. The weight is transmitted along back brace 310 to belt 400. In addition, first arm 304 and second arm 206 of back brace 310, which lie adjacent the scapular and shoulder regions of wearer 1001 while in use, also bend forward from the rear of wearer 1001 to support the weight of armor vest 300 off of shoulders of wearer 1001.

Figure 14:
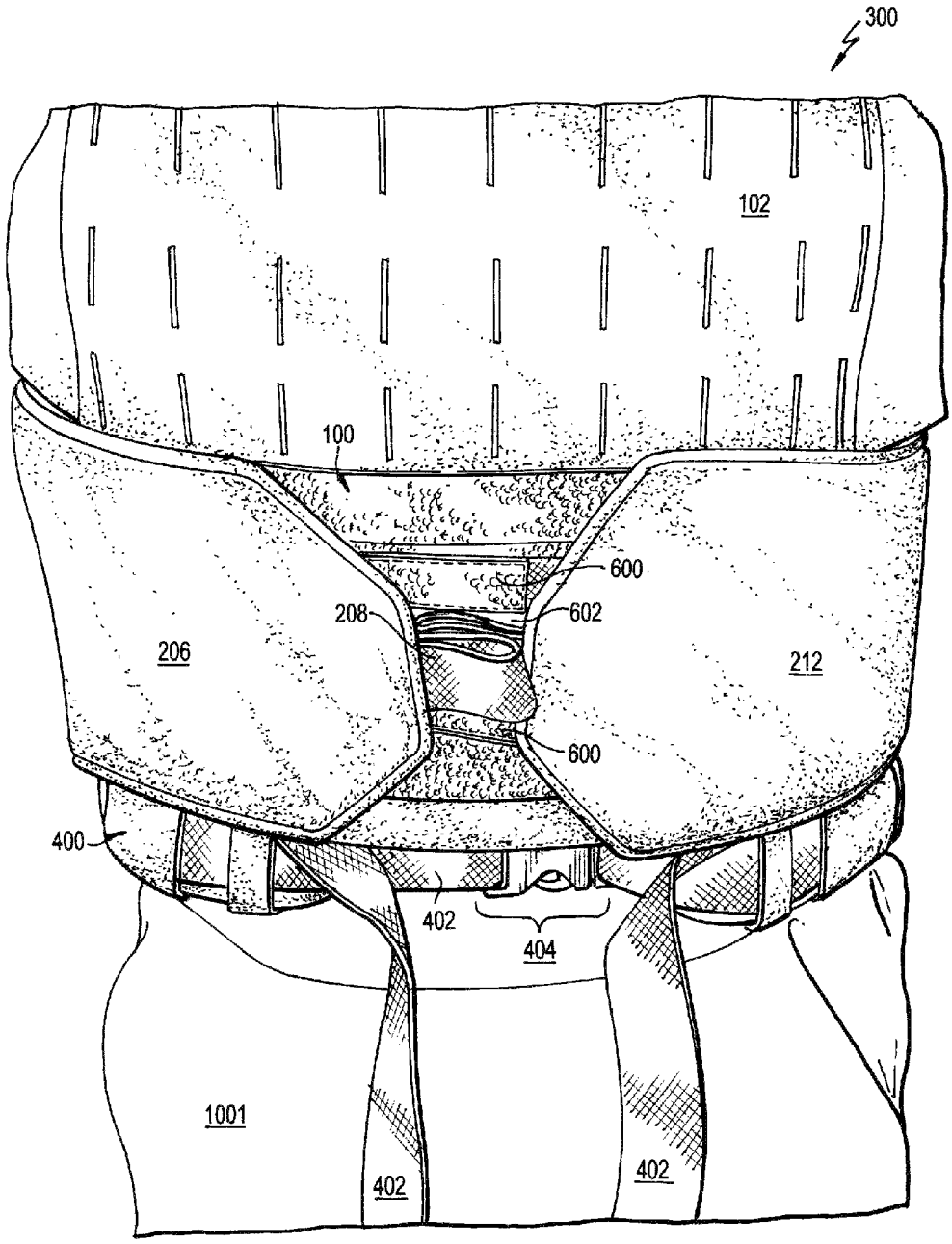
FIG. 14 shows yet another front perspective view of the armor vest showing side panels.
Figure 15:
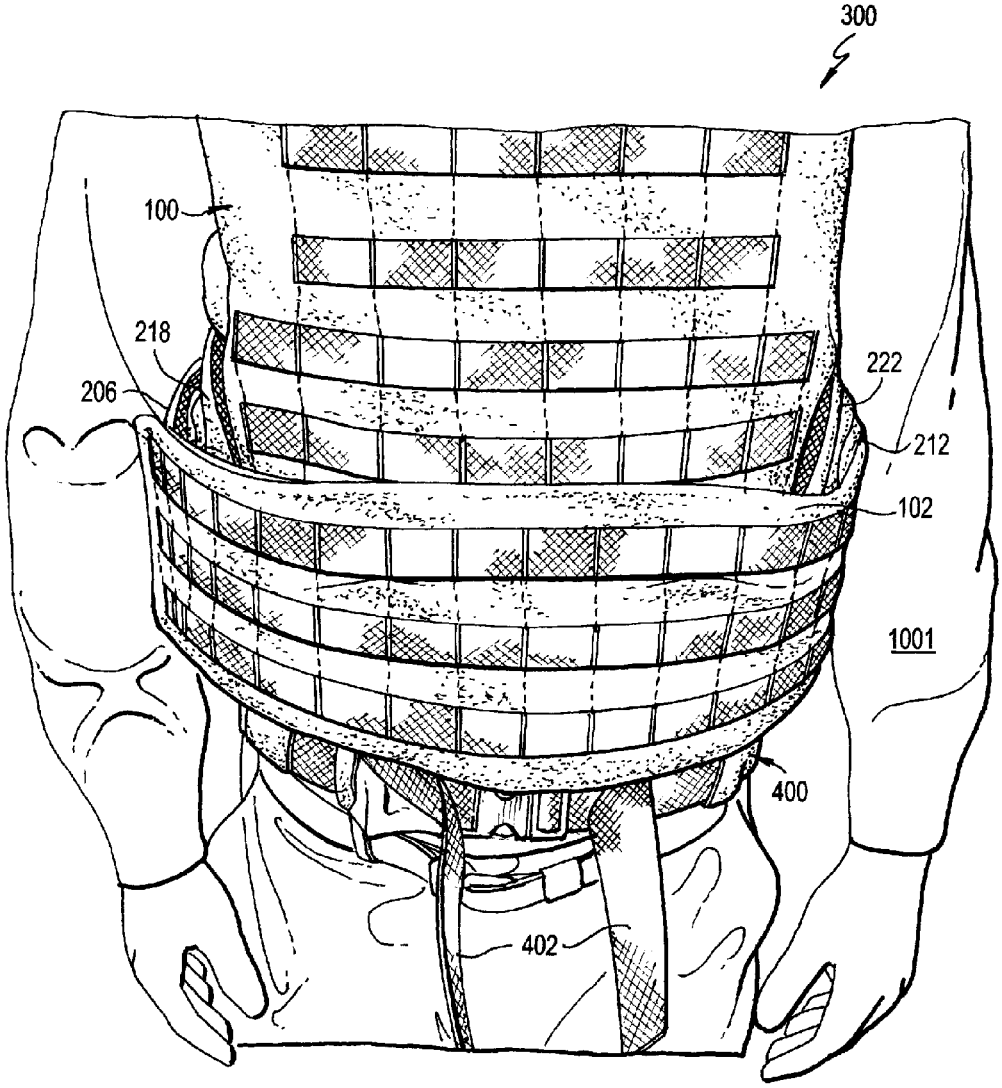
FIG. 15 shows another front perspective view of the armor vest showing the flap closed.

Velcro along the free ends of securement strap 600 may be attached to corresponding Velcro along the front of front portion 100 of armor vest 300 as shown in FIG. 13. Then, first side panel 206 and second side panel 212 may be wrapped around the side of armor vest 300 and attached to Velcro positioned on front portion 100 of armor vest 300 and Velcro positioned on free ends of securement strap 600 as shown in FIG. 14. Finally, flap 102 of front portion 100 of armor vest 300 is flipped downward so that the Velcro on the rear surface of flap 102 engages corresponding Velcro on first side panel 206 and second side panel 212 as shown in FIG. 15.

Armor vest may be removed by reversing the aforementioned steps for donning it. Loop 208 and loop 214 shown in FIG. 14 may be used to pull first side panel 206 and second side panel 212 away from front portion of vest.

Velcro is described throughout description and shown throughout the figures as a means to secure parts of armor vest 300 together. Alternative forms of removeable attachments may be used, including but not limited to, buttons, snaps, or other suitable forms of attachment.

Clasps may comprise plastic or other suitable forms of material for attachment. Any form of clasps, buckles, and other suitable forms of connectors may be used.

D-rings, rings, and strap connectors may comprise plastic, metal, or other suitable forms of material for creating static and dynamic connections with the strap support 500.

Belt 400 may comprise a multilayered materials including padding and foam configured for a comfort fit.

The present invention may be used in connection with back packs, alternative types of armor vests and plate carriers, and other applications requiring use of a support system to redistribute weight away from the shoulders of a wearer of a system implementing the present invention. As shown throughout the figures, armor vest 300 may have additional straps attached along various aspects of its surface for holding packs, grenades, carabineers, and other devices and materials.

While preferred embodiments of the present invention have been shown and described, it will be apparent to those skilled in the art that many changes and modifications may be made without departing from the invention in its broader aspects. The appended claims are intended to cover, therefore, all such changes and modifications as fall within the true spirit and scope of the invention.

We claim:

1. A load distribution device for an armor vest comprising a front portion and a rear portion, the load distribution device comprising:

a back brace designed to be secured to the rear portion of the armor vest, the back brace comprising a lower portion;

a belt comprising a central rear portion, a pocket disposed in the central rear portion, and a rigid support, at least a first portion of which is disposed in the pocket; and a coupling designed to couple the lower portion of the back brace to the rigid support, the coupling comprising an interface housing comprising a pocket, wherein at least a second portion of the rigid support is disposed within the pocket of the interface housing, and wherein the interface housing is designed to couple the lower portion of the back brace to the rigid insert.

2. The load distribution device of claim 1, wherein the back brace further comprises a flat body, and wherein the rigid support comprises a flat body.

3. The load distribution device of claim 2, wherein the back brace further comprises two arms, the back brace having a Y-shape.

4. The load distribution device of claim 1, wherein the armor vest further comprises at least two straps connecting the front portion of the armor vest to the rear portion of the armor vest through respective ring-like devices.

5. The load distribution device of claim 4, wherein each strap comprises a clasp for removably attaching the each strap to the front portion of the armor vest.

6. The load distribution device of claim 4, wherein each strap creates a cinch fit between the front portion and the rear portion of the armor vest.

7. A weight distribution system comprising:

a waist belt comprising a central rear portion, a pocket disposed in the central rear portion, and a rigid support, at least a first portion of which is disposed in the pocket;

an armor vest comprising a front portion, a rear portion, and a load bearing device for supporting a load contained within the armor vest, the load bearing device comprising a lower portion; and a coupling designed to couple the load bearing device to the rigid support, the coupling comprising an interface housing comprising a pocket, wherein at least a second portion of the rigid support is disposed within the pocket of the interface housing, and wherein the interface housing is designed to couple the lower portion of the load bearing device to the rigid insert.

8. The weight distribution system of claim 7, wherein the load bearing device is a back brace positioned within the rear portion of the armor vest.

9. The weight distribution system of claim 7, wherein the load bearing device comprises a flexible yet partially rigid body for supporting the load within the armor vest.

10. A load bearing weight distribution system comprising:

a waist belt comprising a central rear portion, a pocket disposed in the central rear portion, and a rigid support, at least a first portion of which is disposed in the pocket;

an armor vest comprising a front portion, a rear portion, and a back brace for supporting a load contained within the armor vest, the back brace comprising a lower portion;

a coupling designed to couple the back brace to the rigid support, the coupling comprising an interface housing comprising a pocket; and a tensioning mechanism for lifting a portion of the load contained within the armor vest off the shoulders of a wearer and redistributing the portion of the load to the waist belt via the coupling, wherein at least a second portion of the rigid support is disposed within the pocket of the interface housing, and wherein the interface housing is designed to couple the lower portion of the back brace to the rigid insert.

11. The load bearing weight distribution system of claim 10, wherein the back brace comprises a flexible body and a pair of arms designed to bear the portion of the load contained within the armor vest and to redistribute the portion of the load to the waist belt.

12. The load bearing weight distribution system of claim 10, wherein the tensioning mechanism comprises a first securement strap and a second securement strap.

13. The load bearing weight distribution system of claim 12, wherein the first and second securement straps are designed to be cinched for lifting the portion of the load contained within the armor vest off the shoulders of the wearer and redistributing the portion of the load to the waist belt.

14. The load bearing weight distribution system of claim 13, wherein the first securement strap and the second securement strap connect the front portion of the armor vest to the rear portion of the armor vest, and wherein the first securement strap communicates through a first channel and a first ring in the rear portion of the armor vest and the second securement strap communicates through a second channel and a second ring in the rear portion of the armor vest, the first and second securement straps designed to connect to a securement device positioned in the front portion of the armor vest.

15. The load distribution device of claim 1, wherein the coupling further comprises:

a belt attachment interface attached to the rear portion of the armor vest, wherein the interface housing is designed to attach to the belt attachment interface to couple the lower portion of the back brace to the rigid support.

16. The load distribution device of claim 15, wherein:

the belt attachment interface comprises a first plurality horizontal straps, and the interface housing further comprises a second plurality of horizontal straps and at least one attachment strap designed to be woven through selected ones of the first and second pluralities of horizontal straps to couple the lower portion of the back brace to the rigid support.

17. The weight distribution system of claim 7, wherein the armor vest further comprises at least two straps connecting the front portion of the armor vest to the rear portion of the armor vest through respective ring-like devices, wherein the armor vest further comprises a first side portion and a second side portion, and wherein each strap is slidably positioned within a corresponding passage in a respective one of the first and second side portions.

18. The weight distribution system of claim 17, wherein the at least two straps are designed for lifting at least a portion of the load contained within the armor vest off the shoulders of a wearer and redistributing the portion of the load to the waist belt through the coupling.

* * * * *